United States Patent [19]

Principe

[11] Patent Number: 4,662,293

[45] Date of Patent: May 5, 1987

[54] SHUTTLE

[75] Inventor: Viktor Principe, Romanshorn, Switzerland

[73] Assignee: Arthur Schmid AG, Switzerland

[21] Appl. No.: 235,763

[22] Filed: Feb. 18, 1981

[30] Foreign Application Priority Data

Feb. 19, 1980 [CH] Switzerland ..... 1328/80

[51] Int. Cl.[4] ..... D05B 57/10

[52] U.S. Cl. ..... 112/234

[58] Field of Search ..... 112/233, 234, 195

[56] References Cited

U.S. PATENT DOCUMENTS

| | | | |
|---|---|---|---|
| 120,731 | 11/1871 | Fairfield | 112/233 |
| 148,072 | 3/1874 | Knox | 112/233 |
| 232,248 | 9/1880 | Eldredge | 112/233 |
| 243,750 | 7/1881 | Yentzer | 112/233 |
| 257,204 | 5/1882 | Becker | 112/233 |
| 264,333 | 9/1882 | Parsons | 112/233 |
| 308,016 | 11/1884 | Tracy | 112/233 X |
| 817,744 | 4/1906 | Berger | 112/234 |
| 3,253,558 | 5/1966 | Hagen | 112/234 X |

FOREIGN PATENT DOCUMENTS

| | | | |
|---|---|---|---|
| 1685126 | 11/1972 | Fed. Rep. of Germany | 112/234 |

*Primary Examiner*—W. C. Reynolds

*Attorney, Agent, or Firm*—Thomas W. Speckman

[57] ABSTRACT

A shuttle for embroidery and stitching machines having a thread exit slit in its side wall, the slit sloping upward towards the rear end of the shuttle moving the shuttle thread away from the sliding surface and the shuttle race to prevent the thread from becoming jammed.

4 Claims, 4 Drawing Figures

SHUTTLE

BACKGROUND AND SUMMARY OF THE INVENTION

This invention relates to a shuttle for embroidery and stitching machines. In multi-needle embroidery machines, the shuttles keep moving constantly up and down along their path, passing through the loops momentarily formed by the needles during the embroidering operation. When changing color or repeat (round of pattern), the needles are at rest while the shuttle continues to oscillate in a vertical direction. It may then happen that the shuttle thread gets caught between the sliding surface and the shuttle race, or that it adheres to the underside of the cover. Such entanglement is detrimental to the evenness of the embroidery pattern being worked and may even lead to a breakage of the shuttle thread.

An object of the present invention is to create a shuttle by which the danger of the shuttle thread becoming jammed is lessened or entirely avoided.

This object is achieved according to the invention by a novel shuttle having its side wall provided with a slit for the exit or discharge of the thread, instead of an annular exit opening. The slit is designed to slope upward towards the rear end of the shuttle.

BRIEF DESCRIPTION OF THE DRAWINGS

The invention will be described in further detail with reference to the exemplary embodiments illustrated in the drawings, in which.

DESCRIPTION OF PREFERRED EMBODIMENTS

Figure 1:
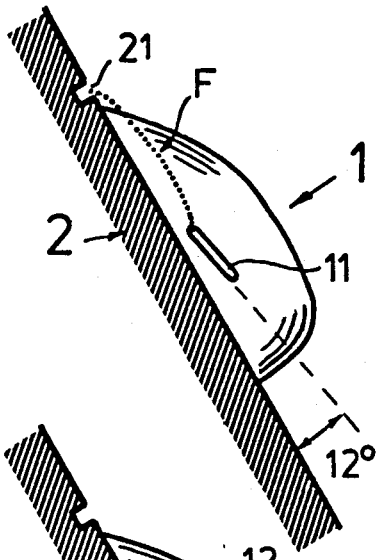
FIGS. 1–3 are side view of shuttles according to the present invention which are distinguished from each other only by the different degrees of the slope of the thread exit slit.

Referring to FIG. 1, the shuttle 1 is positioned on a shuttle race or track 2, indicated merely schematically. The race 2 is provided with a needle slot 21 to receive the needle in the stitch forming operation. As the shuttle moves upward along the race 2, it passes through the loop formed by the needle. It will be appreciated that during the downward return movement of the shuttle to its starting position, a certain length of the shuttle thread F hangs out of the slit 11, which replaces in the present practice the heretofore conventional round opening or hole, on one side of the shuttle. Since the thread exit slit is sloping upward toward the rear side of the shuttle and the shuttle experiences a rapid acceleration during the upward movement, the effect of inertia causes the thread F to slide rearward in the slit 11. As a consequence, the thread is pulled away from the sliding surface of the shuttle and the danger of its being caught is greatly reduced.

Figure 2:
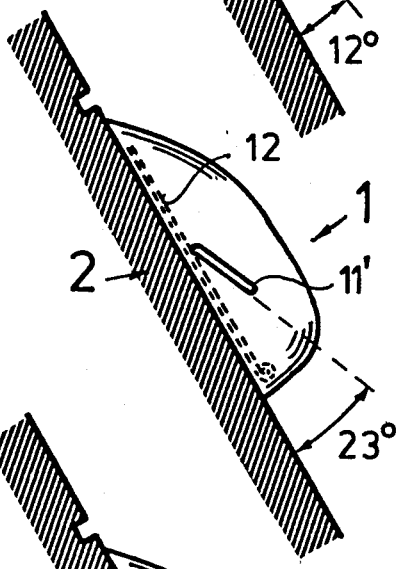

It is suitable for the thread exit slit to form an angle of 5° to 45° with the shuttle sliding surface, preferred is about 12° to 45°. In the embodiment of FIG. 1, the thread exit slit 11 provided in the shuttle 1 forms an angle of 12° with the shuttle sliding surface. In the shuttle of FIG. 2 having a slit 11', this angle is 23° , and in the embodiment of FIG. 3, the angle amounts to 45°. The lower end of the sloping slit is approximately at the level of the inner surface of the cover 12 as shown in FIG. 2.

Figure 3:
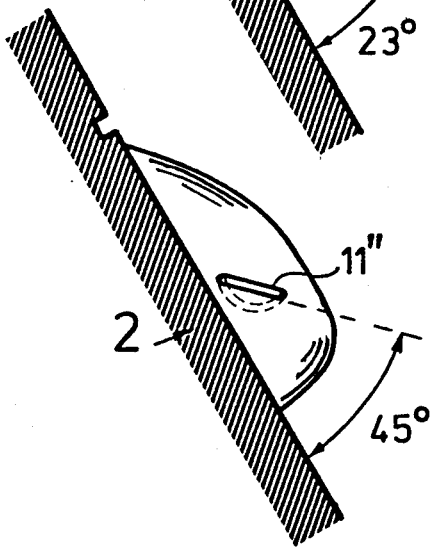

It may also be of advantage to impart a curvature to the slit according to the invention as shown by the broken lines in FIG. 3.

Figure 4:
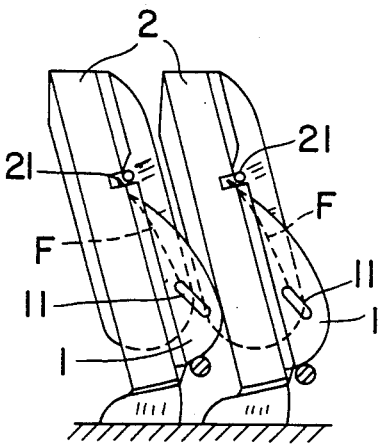
FIG. 4 is a side view of multiple covered shuttles according to this invention which oscillate along vertically inclined shuttle tracks.

FIG. 4 shows multiple shuttles of the embodiment shown in FIG. 3 of the type which oscillate along vertically inclined shuttle tracks.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. In a shuttle of the type for embroidery machines having multiple covered shuttles having thread exiting from the interior of the shuttle cover through a side wall opening, said shuttles being of the type which oscillate along vertically inclined shuttle tracks passing through loops of thread formed by needles, the improvement comprising; said side wall thread exit opening being a thread exit closed ended slit extending at an angle to said shuttle track, the distance between said thread exit slit and said shuttle track increasing toward the rear side of said shuttle cover, rapid acceleration of said shuttle in an upward direction causing said thread to slide rearward in said thread exit slit lifting said thread away from said shuttle track.

2. A shuttle according to claim 1, characterized in that said thread exit slit starts at the level of the inner surface of said shuttle cover to slope upwardly.

3. A shuttle according to claim 1 characterized in that said thread exit slit forms an angle of between 5° and 45° with said vertically inclined slide shuttle track.

4. A shuttle according to claim 1, characterized in that said thread exit slit is curved.

* * * * *